United States Patent [19]

Jantzen

[11] Patent Number: 4,892,367

[45] Date of Patent: Jan. 9, 1990

[54] STORAGE CABINET WITH PIVOTING STORAGE COMPARTMENTS

[75] Inventor: Eric Jantzen, Ville d'Avray, France

[73] Assignee: Gefitec S.A., Lausanne, Switzerland

[21] Appl. No.: 249,843

[22] Filed: Sep. 27, 1988

[30] Foreign Application Priority Data

Sep. 30, 1987 [FR] France ..... 87 13538

[51] Int. Cl.[4] ..... A47B 88/00

[52] U.S. Cl. ..... 312/328; 312/296

[58] Field of Search ..... 312/327, 328, 305, 296, 312/325, 276

[56] References Cited

U.S. PATENT DOCUMENTS

| | | | |
|---|---|---|---|
| 1,725,423 | 8/1929 | Schimmel | 312/328 |
| 1,883,776 | 10/1932 | Forsyth | 312/305 X |
| 4,391,478 | 7/1983 | Grunert | 312/296 X |
| 4,616,891 | 10/1986 | Jantzen | 312/328 |

*Primary Examiner*—Joseph Falk

*Attorney, Agent, or Firm*—Charles Fallow; Martin Hoffman

[57] ABSTRACT

The storage cabinet comprises a frame supporting at least two superimposed rows of pivoting storage modules.

The closing-opening angle of rotation $\beta$ of the storage modules is calculated according to the center distance y of the axes of rotation of the modules and of the distance x between the plane defined by the rear upper edges of the storage modules and the plane defined by the front lower edges of the storage modules according to the equation $\sin \beta = x/y$.

The difference between the levels of the lower edge of the front wall of an upper adjacent module and of the upper edge of the rear wall of a lower module is calculated according to the equation $z = y\,(1 - \cos \beta)$.

The upper edge of the rear wall of a lower storage module comes in the simultaneous opening movement to stop on the lower edge of the front wall of the adjacent upper storage module so as to precisely stop rotation of the storage modules.

8 Claims, 9 Drawing Sheets

STORAGE CABINET WITH PIVOTING STORAGE COMPARTMENTS

FIELD OF THE INVENTION

The object of the present invention is to provide a storage cabinet with pivoting storage compartments, comprising a frame supporting at least two superimposed rows of storage modules mounted on the frame so as to be able to simultaneously pivot by means of at least one connecting rod around parallel horizontal axes in order to simultaneously assume an open or closed position, each storage module being delimited by front and rear walls, two lateral extremity walls and a bottom, the front walls of the storage modules forming in the closed position a continuous plane, the plane defined by the upper rear edges of the storage modules and the plane defined by the lower front edges of the storage modules being parallel and so that the distance x between these two planes is less than or equal to the center distance y of the axes of rotation of the modules, the upper edge of the rear wall of a module being situated on a level lower than that of the lower edge of the front wall of the upper adjacent module and all the superimposed storage modules, except for the upper part of the upper storage module being completely closed by themselves independently of the frame in the closed position.

BACKGROUND OF THE INVENTION By means of the U.S. Pat. No. 1 883 776, storage units are already known which comprise a set of superimposed storage compartments and constituted by trough members pivoting around parallel horizontal axes, control of the opening and closing of the troughs being able to be effected simultaneously by means of a rod. Such a type of storage unit with troughs with a circular section proves not to be very functional in practice, as the storage volume and the angle for opening the troughs are limited. The height spatial requirement of the unit is also relatively large and the objects disposed in the troughs may easily fall out through the rear closed position of the troughs.

The patent EP-B-129 484 describes a storage cabinet with multiple storage compartments which overcomes some of the drawbacks of the unit described in the U.S. Pat. No. 1 883 776 to the extent that it enables a set of pivoting troughs to be disposed inside a compact unit, said troughs defining a large storage volume in containers fully closed in the closed position and being more readily accessible in the open position. Such a storage cabinet, despite its convenience in use, does, however, present drawbacks to the extent that it remains difficult to produce, the various troughs having a shape which renders it difficult to embody by means of moulding, and the means to activate the opening and closing of the pivoting troughs comprising a stopping control mechanism constituted by a rod assembly and relatively complex stop means.

The French Pat. No. 674 936 describes a unit designed in particular to contain gramophone records. This unit comprises two superimposed pivotable drawers interlocked by means of rocker bars and able to be opened or closed simultaneously by means of a handle. These pivotable drawers fully delimit in the closed position closed spaces for the objects. However, in the open position, there is a large free space between the upper wall of the lower drawer and the lower wall of the upper drawer. This discontinuity has a number of drawbacks, as when objects are deposited or removed from the drawers, certain objects may fall into the free space between the two superimposed drawers. Moreover, in the open position, the drawers project backwards over a significant distance with respect to the rear vertical face of the storage unit, which increases the spatial requirement and in particular prevents such a unit being easily held up against a vertical wall.

Moreover, the French Pat. No. 1 117 77 describes a file cabinet for office items and which includes a set of superimposed compartments pivoting around horizontal axes and each having rear and front parallel faces. Apart from the fact that it was not designed to enable fully closed compartments to be defined in the closed position, such a type of storage unit comprises pivoting compartments where opening is individual and which cooperate with relatively complex stop means embodied on the frame at the level of each compartment. Accordingly, such a unit, which is not designed to either provide full closing of the storage compartments in the closed position or to allow for rapid and simultaneous opening of the set of compartments, involves a long, costly and complex production with a large number of parts to be assembled.

The Swiss Pat. No. 97236 similarly relates to a storage unit with pivoting compartments which, in their closing position, do not fully close themselves and which define in the unit only a small effective storage volume.

SUMMARY OF THE INVENTION

The present invention seeks to overcome the aforesaid drawbacks and to embody a storage cabinet with pivoting storage compartments and offering more reliability and which is convenient to use and allows for simultaneous access to all the storage compartments, which offers a large storage volume in containers having excellent visibility and accessibility in the open position and are able to be perfectly closed in the closed position, if appropriate, and which is constituted from a reduced number of elementary parts whose production and assembling are easy to embody.

A further object of the invention is to provide a storage cabinet able to be adapted to both store bulk items and store objects of a predetermined shape piled in the storage compartments and which guarantees an absence of any jamming of the storage compartments or the stored objects when the cabinet is being opened or closed.

These objectives are obtained by means of a storage cabinet of the type defined at the top of the description, wherein the opening-closing angle of rotation of the storage modules is calculated according to the center distance y of the axes of rotation and said distance x according to the equation $\sin\beta = x/y$, wherein the difference z between the levels of said lower edge and of said upper edge is calculated according to the equation $z = y\,(1-\cos\beta)$ where y is the center distance of the axes of rotation of the modules in question and $\beta$ is the angle of rotation of these modules, and wherein the walls of the storage compartment are embodied in such a way that the upper edge of the rear wall of a lower storage module, as regards the simultaneous opening movement, comes and stops at the final point on the lower edge of the front wall of the upper adjacent storage module so as to precisely halt the rotation of the storage modules and ensure in the open position the connecting and continuity of the rear wall of the lower storage module with the front wall of the upper adjacent storage module so that the two wall then become approximately aligned and parallel in such a way that, in the open position, the total useful section of the storage volume defined by each storage module appears visible and accessible.

The lateral extremity walls of two adjacent storage modules may overlap, at least partly along complementary cuttings, so as to close at the lateral extremities the storage modules in the closed position, independently of the frame.

Intermediate partitions parallel to the lateral walls of the storage modules may be provided so as to determine in the closed position of the storage modules, compartments closed by being connected to the bottom of the upper adjacent module with a complementary form or to a rib with an complementary form adjacent to the bottom of the adjacent upper storage module and for the upper extremity module by being connected to a partition with a complementary form integral with the frame.

According to one advantageous embodiment, the centers of rotation of the storage modules are situated at the rear of the plane defined by the rear upper stop edges of the storage modules.

According to another preferred embodiment, the centers of rotation of the storage modules are situated below and in an intermediate position with respect to the centers of gravity of the modules respectively corresponding to one closing position and one opening position, so as to enable the modules to tilt or pivot naturally in their two closing and opening positions.

The cabinet according to the invention can be adapted to the storing of mainly parallelpiped solid objects extending over almost the entire height of the storage modules, such as boxes of audio or video cassettes or boxes of compact disks.

In this case, the bottom wall of the storage modules is in the form of steps and the lateral walls of the modules end at their upper part by edges, also in the form of steps and situated at a certain distance below the upper edges of the front and rear walls of the storage modules.

The main object of the present invention is to provide a storage cabinet defining a storage volume with a mainly parallelepiped shape in which disposed is a set of n superimposed rows of storage modules mounted so as to be able to pivot simultaneously (with $n \geqq 2$).

More specifically according to the present invention, the storage modules are embodied specifically so that by means of the play of a simultaneous rotation, the n storage modules have the property of alternatively assuming a first position in which the modules are entirely closed by themselves (except for the upper part of the upper module which shall cooperate with the frame) and a second position in which the modules are open over their entire section ensuring continuity of the rear bottom, the rear wall of a given module (except here again the upper module) coming to stop in continuity on the front wall of the module situated immediately above said given module.

Accordingly, in the storage cabinet according to the present invention, in the closed position there is perfect imperviousness of the storage modules which in particular prevents small objects from falling out of their storage compartment, and also when the storage cabinet is turned upside down.

By means of the specific configuration of the storage cabinet and due to the special relative dimensions of the various essential parts, during the simultaneous rotating movement of the storage modules from their opening position to their closing position, the lower part of each module fully escapes with respect to the upper part of the immediately lower module so that the modules do not jam against each other, even though imperviousness is continuously retained.

Moreover, at the end of the operation for opening the storage modules, stopping rotation of the modules is effected precisely and avoids jamming due to the final point stop of the front wall of an adjacent upper module and the final point stop of the rear wall of the immediately lower storage module coming against each other.

The storage volume as regards the entire storage cabinet is optimized and accessibility to the objects, as well as their visibility in the open position of the modules, are also brought to their maximum degree, the entire useful storage section being accessible. The guiding of objects towards the output of the modules is also moreover ensured at the upper part of the modules owing to the continuity of the walls.

Finally, the production of the storage cabinet according to the invention is particularly easy to assemble and lends itself (in the absence of re-entrant angles) to a moulding manufacture.

BRIEF DESCRIPTION OF THE DRAWINGS

Other characteristics and advantages of the invention shall appear from the following description of the particular embodiments of the invention given by way of example, with reference to the annexed drawings in which.

DETAILED DESCRIPTION OF THE PREFERRED EMBODIMENTS

FIGS. 3 and 5 to 9 show, by means of the full lines, the storage modules 100, 200, 300, 400 in their closing position and by means of the broken lines these same storage modules as they appear in the opening position. Moreover, in order to facilitate understanding the drawings, the various main elements of the storage modules or associated elements have been denoted by a reference number not allocated from the prime sign when they are shown in the closing position of the storage modules, but allocated from the prime sign when they are shown in the opening position of the storage modules. Unless specified otherwise, the different elements shall be described hereafter by being essentially denoted by their basic reference number not allocated from the prime sign.

Figure 1:
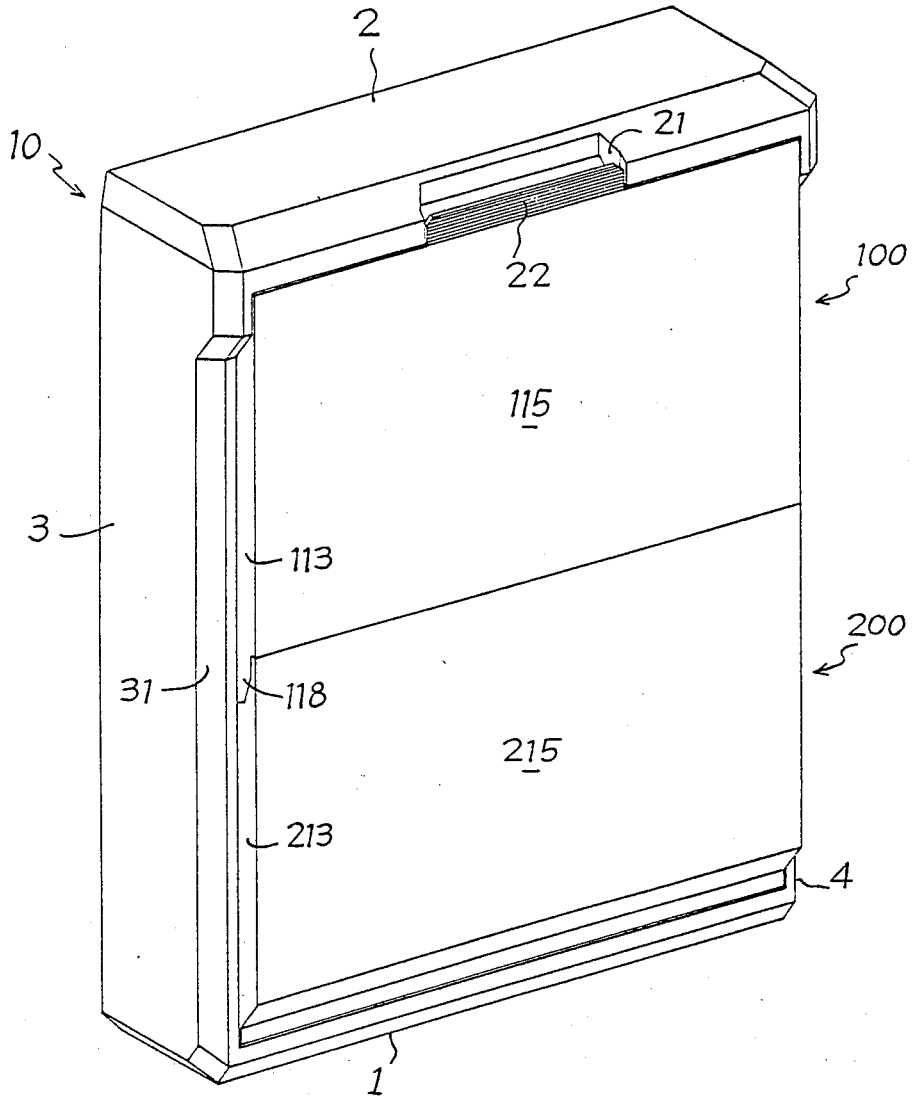
FIG. 1 is a perspective view of an example of a storage cabinet according to the invention, the various storage modules being in the closed position.
Figure 2:
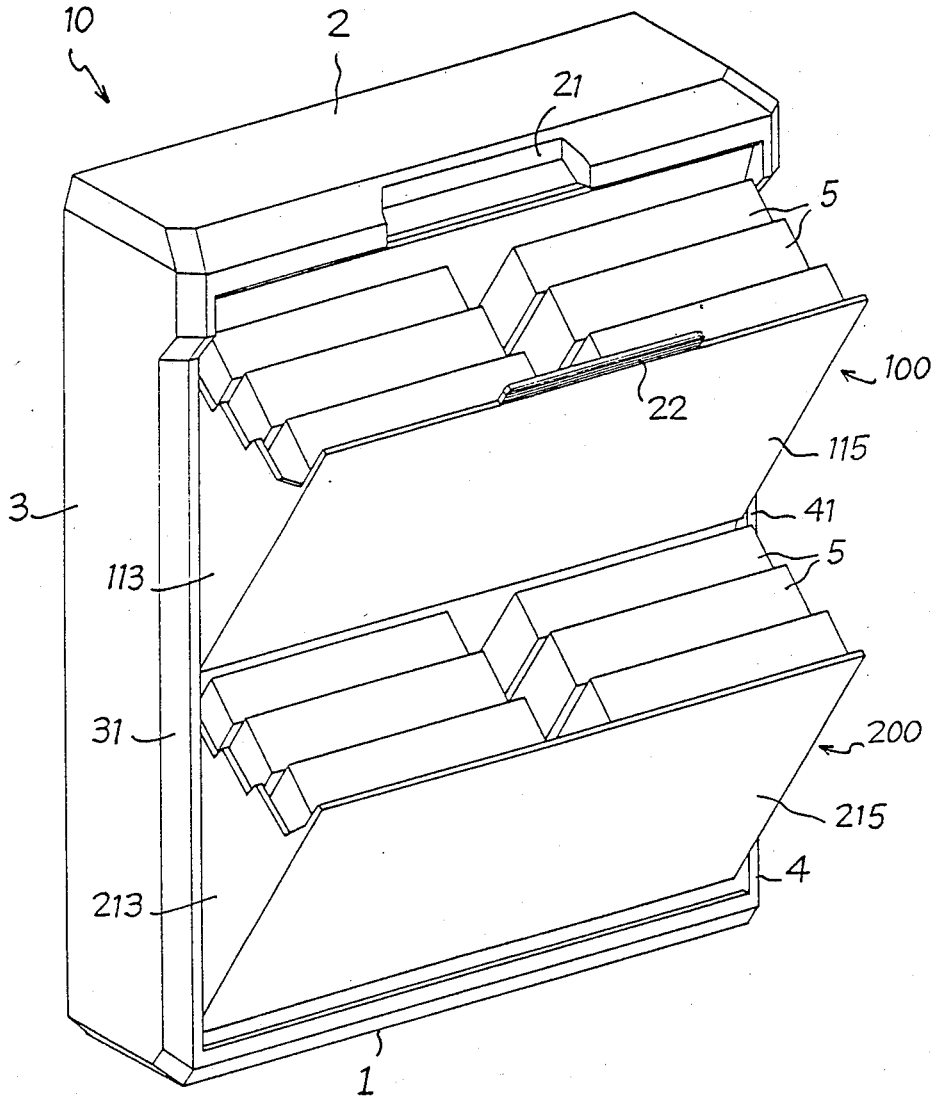
FIG. 2 is a perspective view similar to FIG. 1, but the storage modules are in the open position forming a display cabinet.

According to a first embodiment illustrated by FIGS. 1 to 4, the storage cabinet includes a frame 10 essentially comprising a base 1, an upper wall 2 and two lateral walls 3, 4 whose back end part 31, 41 at the front of the cabinet may be slightly offset with respect to the front face formed by the bringing together of the front faces 115, 215 of the various storage modules 100, 200 supported by the frame 10 when these modules are in the closed position (FIG. 1). This facilitates the gripping of objects 5 disposed at the bottom of the compartments of the storage modules 100, 200 when the modules are in the opening position (FIG. 2). An offset portion 21 may be formed inside the upper wall 2 of the frame 10 in order to free a device 22 to control the storage modules 100, 200 and which may be constituted by a plain tongue extending the front face 115 of the upper module 100 into its central part.

Figure 3:
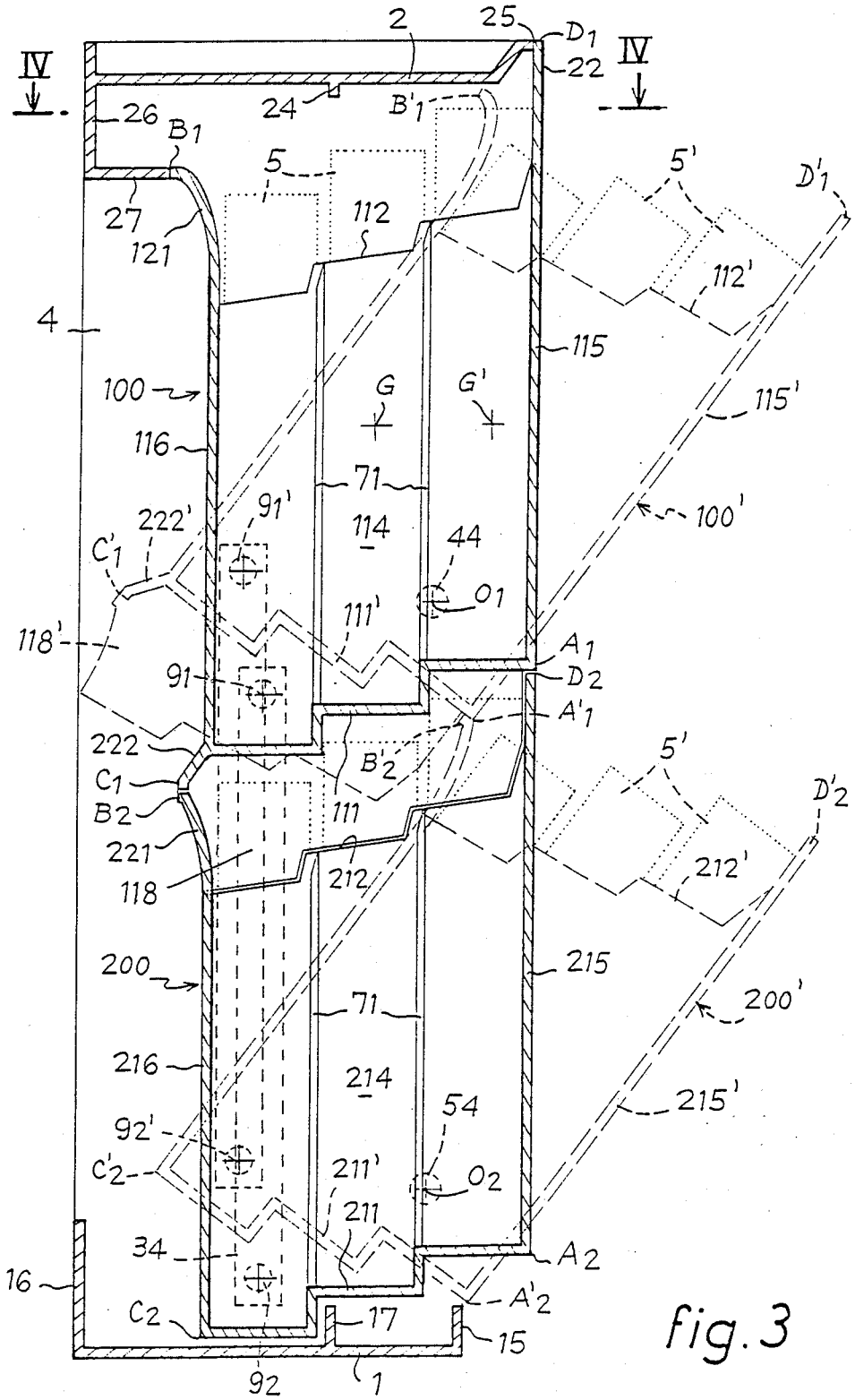
FIG. 3 is a vertical sectional view along the line III—III of FIG. 4 showing the form and disposition of the storage modules according to a first embodiment.

In order to more clearly understand the structure constituted by the storage modules 100, 200 and the cooperation between the storage modules 100, 200 and the frame 10, reference shall now be made to FIG. 3. As shown on FIG. 3, the base 1 of the frame 10 may include vertical reinforcing ribs 15, 16, 17 which surmount the plate forming the actual base 1. Similarly, vertical ribs 24, 26 directed towards the interior of the cabinet may serve as means to stiffen the upper wall 2, together with the offset portion 21, and the free frontal extremity 25 which acts as a stop for the tongue 22 in the closing position of the modules 100, 200.

FIGS. 1 to 4 have only shown two pivoting storage modules, namely an upper module 100 and a lower module 200. However, it is possible to select a larger number of superimposed modules, for example a series of three, four or five superimposed modules. In this case, the intermediate modules between the upper module and the lower module have an upper part almost similar to the upper part of the module 200 and a lower part almost similar to the lower part of the module 100.

Generally speaking, the storage modules 100, 200 mounted pivoting around horizontal axes 01, 02 situated in a given vertical plane have a front plane wall 115, 215 which is vertical in the closing position of the modules, a rear wall 116, 216 which is also mainly level and parallel to the front wall 115, 215, and a bottom wall 111, 211 which, viewed as a vertical section, may be level, partially or totally curved or even formed by a dotted line. The embodiment of FIGS. 1 to 4 corresponds to this latter case with a bottom wall 111, 211 ranged in steps with an average slope inclined towards the bottom at the rear of the modules.

The storage modules 100, 200 are connected together by plain connecting rods 33, 34 (FIGS. 3 and 4) joined to the lateral faces 113, 213 respectively, 114, 214 of the modules 100, 200 around horizontal axes 91, 92 situated inside a given vertical plane. The pivoting axes 01, 02 pivot inside bearings 43, 44 respectively 53, 54 supported by the lateral faces 3 respectively 4 of the frame 10 and constitute the only link between the storage modules 100, 200 and the frame 10, apart from the cooperation between the upper part of the module 100 and the upper wall 2 of the frame. Thus, there is a large amount of freedom in the conception of the frame 10 and the latter could even be reduced to a simple support frame for supporting the spin axes 01, 02 as shown on FIG. 9 in relation with another embodiment. In order to avoid the falling of objects stored in the storage module, even if the lateral walls 3, 4 of the frame 10 are narrower than the distance between the front walls 115, 215 and rear walls 116, 216 of the storage modules, the storage modules 100, 200 are provided with lateral extremity walls 113, 213 and 114, 214. Central ribs for reinforcing the lateral walls or for retaining objects calibrated with a predetermined form, such as parallelepiped-shaped objects, may be formed towards the interior of the compartments defined by the storage modules 100, 200 from the lateral walls 113, 213 and 114, 214 or from separations or partitions 119 inside the modules 100, 200 in order to define several storage compartments inside each module.

Figure 5:
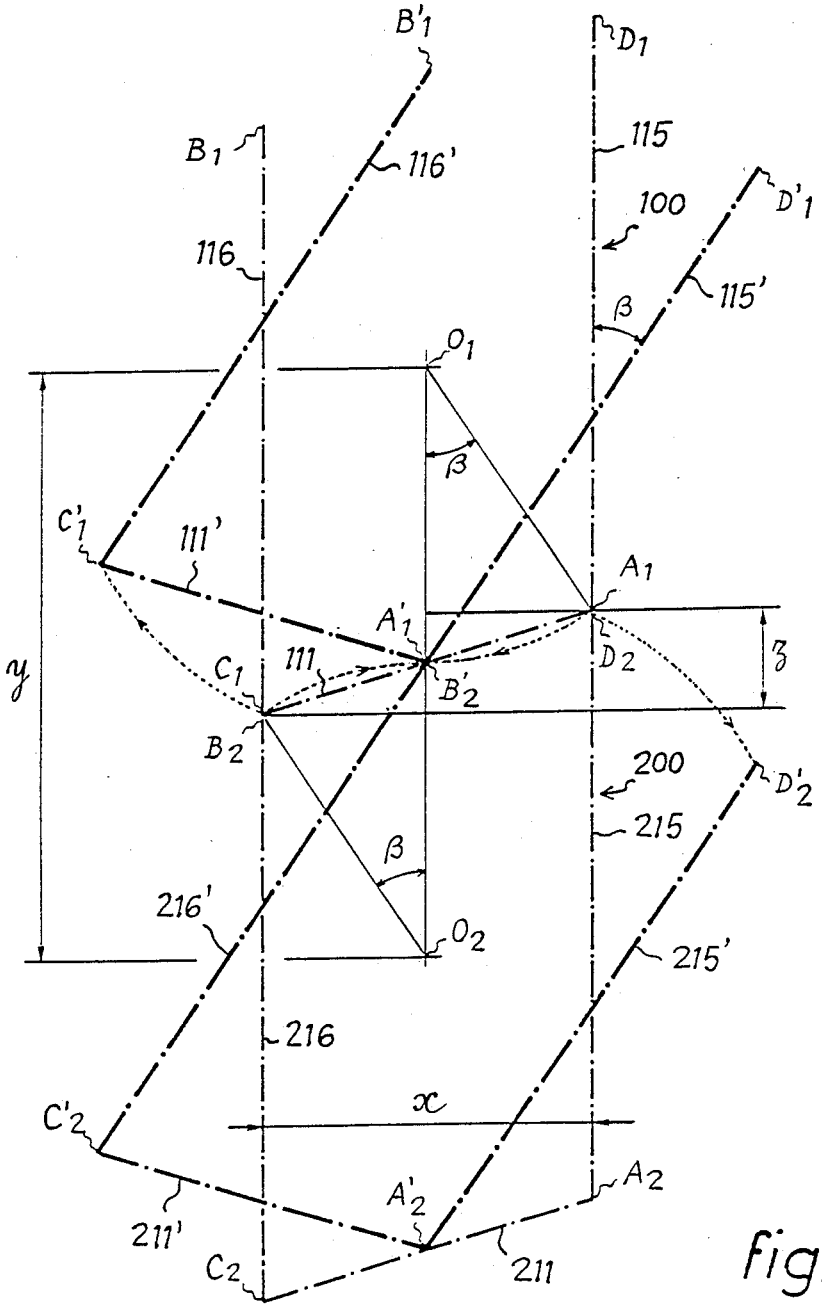
FIG. 5 is a diagrammatic view showing the relative disposition principle of two superimposed storage modules.

Reference should now be made to the diagram of FIG. 5 which makes it possible to more readily understand the cooperation between two superimposed adjacent storage modules 100, 200.

For the upper module 100, the upper edges of the front walls 115 and rear walls 116 have been denoted by the references D1 and B1 respectively, and the lower edges of these same front walls 115 and rear walls 116 by the references A1 and C1. Similarly, for the lower module 200, the references D2 and B2 denote the upper edges of the front walls 215 and rear walls 216 and the references A2 and C2 denote the lower edges of these same front and rear walls 215, 216 respectively. Moreover, the tilting axes 01, 02 of the modules 100, 200 have also been shown on the diagram of FIG. 5.

In the closed position of the modules 100, 200, the front upper edge D2 of the module 200 occurs immediately under the front lower edge A1 of the module 100 and the upper rear edge B2 of the module 200 also occurs immediately under the lower rear edge C1 of the module 100 (FIGS. 3 and 5). The front walls 115, 215 then define a continuous plane and the rear walls 116, 216 are themselves essentially level and situated inside a given plane.

After a rotation of an angle $\beta$ around the pivoting axes 01, 02, the modules 100, 200 simultaneously come into a tilting position towards the front so that the upper edge B2 of the rear wall 216 of the lower storage module 200 comes and stops on the lower edge A1 of the front wall 115 of the upper storage module 100 (see FIGS. 3 and 5 the positions A' and B' of the edges A1 and B2 after tilting).

The stop of the upper edge B2 on the lower edge A1 make it possible to precisely stop rotation of the modules 100 and 200 without it being necessary to provide other steps on the frame 10. Moreover, in the opening position of the modules 100, 200, continuity is created between the rear wall 216 of the lower storage module 200 and the front wall of the upper storage module 100, and the two walls 115, 116 in their opening position 115', 216' are approximately aligned and parallel. Accordingly and in the opening position, the total section of the storage module 200, as that of the module 100, appears visible and accessible.

As shown on FIG. 5, preferably the plane defined by the upper rear stop edges B1, B2 of the modules 100, 200 and the plane defined by the lower front stop edges A1, A2 of the storage modules 100, 200 are parallel and such that the distance x between these two planes is less than or equal to the center distance of the axes of rotation 01, 02 of the modules 100, 200. The angle of rotation $\beta$ providing the angle of opening of the modules 100, 200 is mainly defined by the following equation:

$$\sin\beta = x/y \quad (1)$$

As this is visible on the drawings, in the closed position of the storage modules, the upper edge B2 of the rear wall 216 of the lower module 200 is situated at a level lower than that of the lower edge A1 of the front wall 215 of the upper module 100, so as to allow for a rotating movement of the modules without jamming occurring. By considering FIG. 5, it can be seen that the difference z between the levels of the lower edge A1 and the upper edge B2 is defined by the following relation:

$$z = y(1-\cos\beta) \quad (2)$$

where y and $\beta$ correspond to the previously given definitions.

Figure 6:
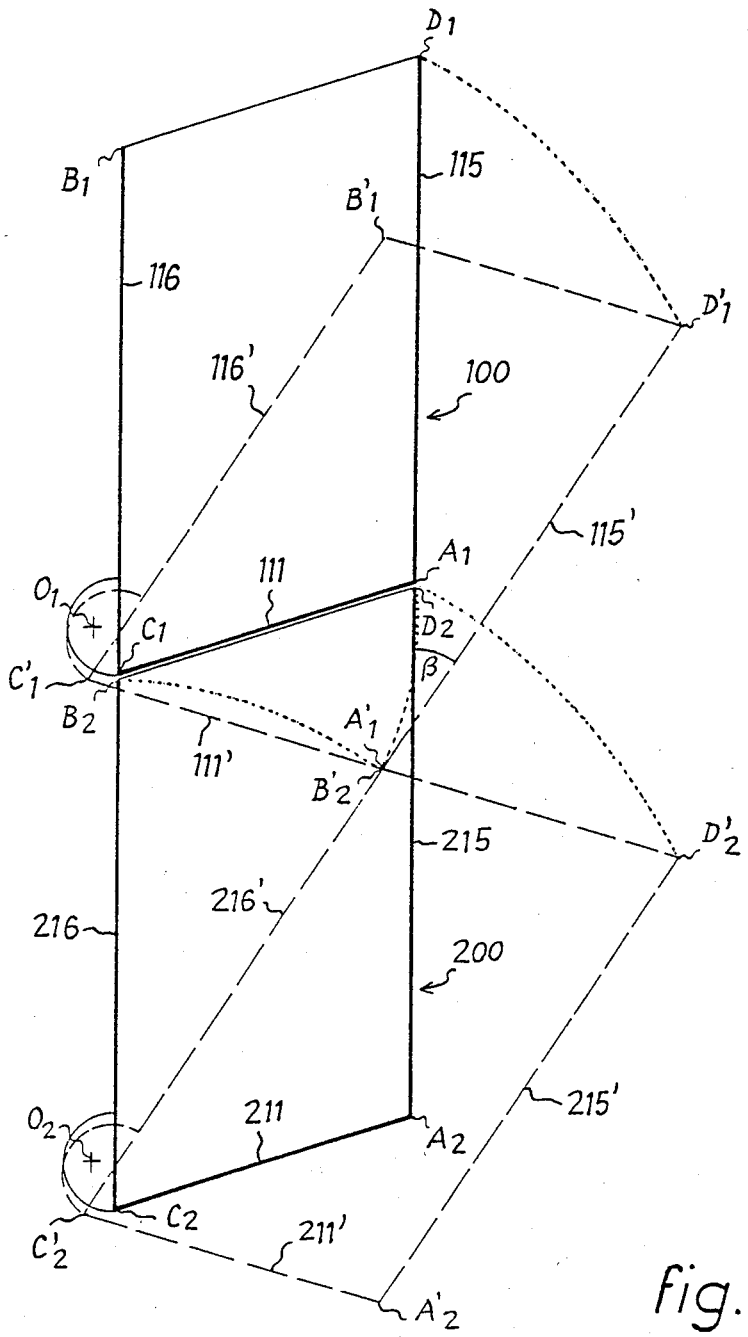
FIG. 6 is a diagrammatic view similar to the view of FIG. 5, but showing a particular mode of a different embodiment with pivoting axes of the storage modules situated to the rear of the rear wall of these storage modules.

It shall be noted that the choice of the location of the axes of rotation 01, 02 of the storage modules 100, 200 is extremely wide. Thus, FIG. 6 diagrammatically shows a disposition in which the axes of rotation 01, 02 are situated at the rear of the vertical plane defined by the upper rear stop edges B1, B2 of the modules 100, 200. This contributes in reducing the play and spatial requirement towards the rear at the time of opening. With such an axes of rotation position, at the rear of the centers of gravity of the modules 10, 200, the storage modules may tilt naturally towards their opening position.

According to a further possible disposition which corresponds to the example of FIG. 3, the centers of rotation 01, 02 of the storage modules 100, 200 are situated below and in an intermediate position with respect to the centers of gravity G, G' of the modules corresponding respectively to a closing position and to an opening position, so as to enable the modules to tilt naturally into their two closing and opening positions.

Figure 4:
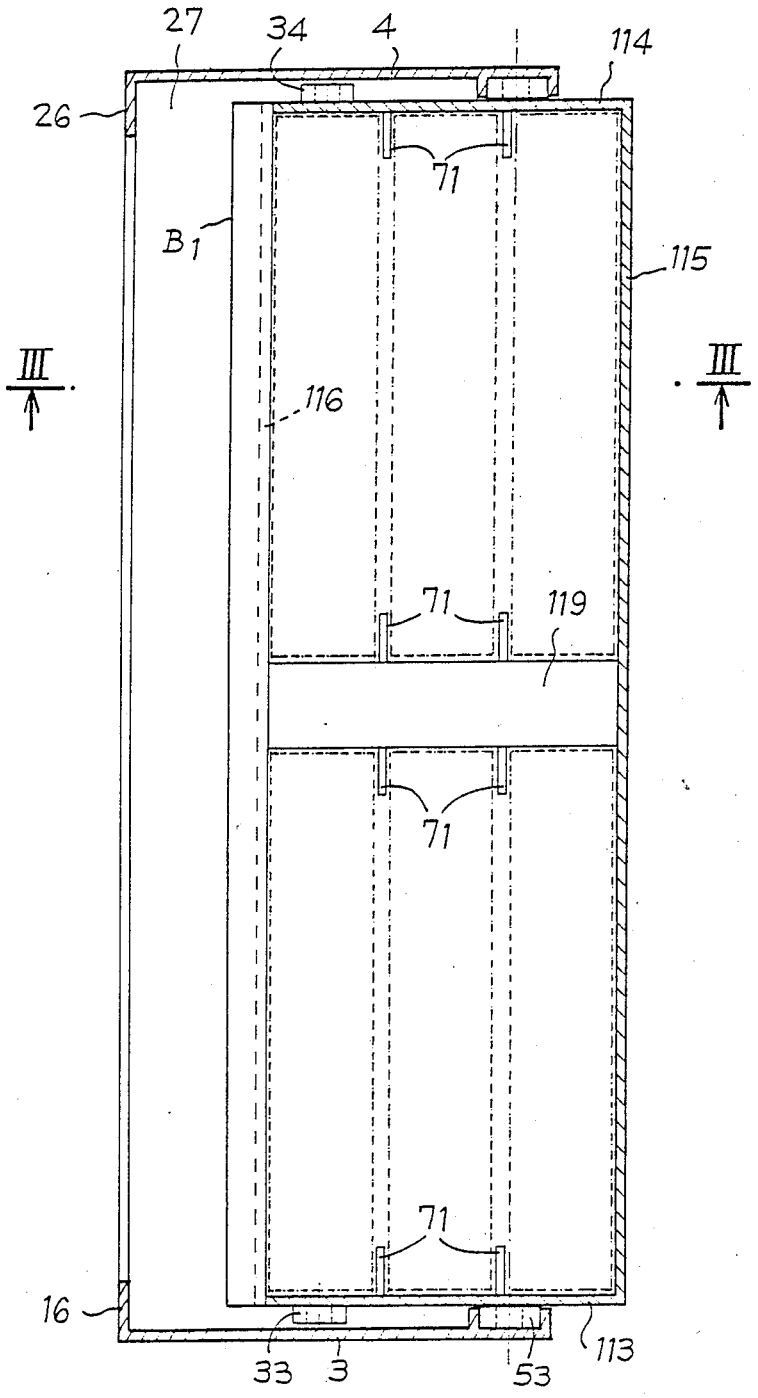
FIG. 4 is a horizontal cutaway view of the embodiment of FIG. 3 taken along the line IV—IV of FIG. 3.

If reference is made to FIGS. 3 and 4, it can be seen that the rear walls 116, 216 of the storage module 100, 200 which, on FIG. 5 have been shown perfectly level, may, whilst remaining essentially level and aligned, have their upper extremities a slight lateral yielding 121, 221 towards the exterior, which enables the angle of opening to be increased and to render easier grasping of the objects 5, such as boxes of audio or video cassettes or boxes of compact disks (CD). This lateral yielding 121, 221 may be constituted by an offset part or a slightly curved part.

The rear wall 116 of the upper module 100 is extended at its lower part by an offset portion 222 forming an angle with the central flat part of the wall 116 in such a way that the lower edge C1 of the rear wall 116 is immediately situated close to the upper edge B2 of the rear wall 216 of the lower module 200 in the closed position of the modules 100, 200. Moreover, the upper edge B1 of the upper module 100 comes and stops on the rear wall 26 of the frame or a lengthening piece 27 integral with this wall 26.

The formulas specified with reference to FIG. 5 apply entirely to the embodiment of FIGS. 3 and 4 if one fully considers the plane passing through the edges B1, C1, B2 and not the principal plane of the rear walls 116, 216 of the modules 100, 200. The lateral extremity walls 113, 213, 114, 214 of the modules 100, 200 may be cut so as to free in an open position the upper part of the objects 5 contained in the compartments of the modules in order to facilitate grasping of the objects. In the case of calibrated parallelepiped objects, such as boxes of cassettes, the bottom wall 111, 211 of the modules 100, 200 is advantageously embodied in the form of steps and the lateral walls 113, 114, 213, 214 of the modules 100, 200 end at their upper part by edges 112, 212, also in the form of steps situated at a certain distance below the upper edges D1, B1, D2, B2 of the front and rear walls of the modules 100, 200.

If reference is made to FIGS. 3 and 4, the lateral extremity walls 113, 114 of the module 100 have portions 118 which extend beyond the bottom wall 11 so as to overlap along cuts complementary to those of the upper part 212 of the lateral walls 213, 214 of the lower module 200 so that the storage modules 100, 200 can be closed at the lateral extremities in the closed position, independently of the frame.

Figure 7:
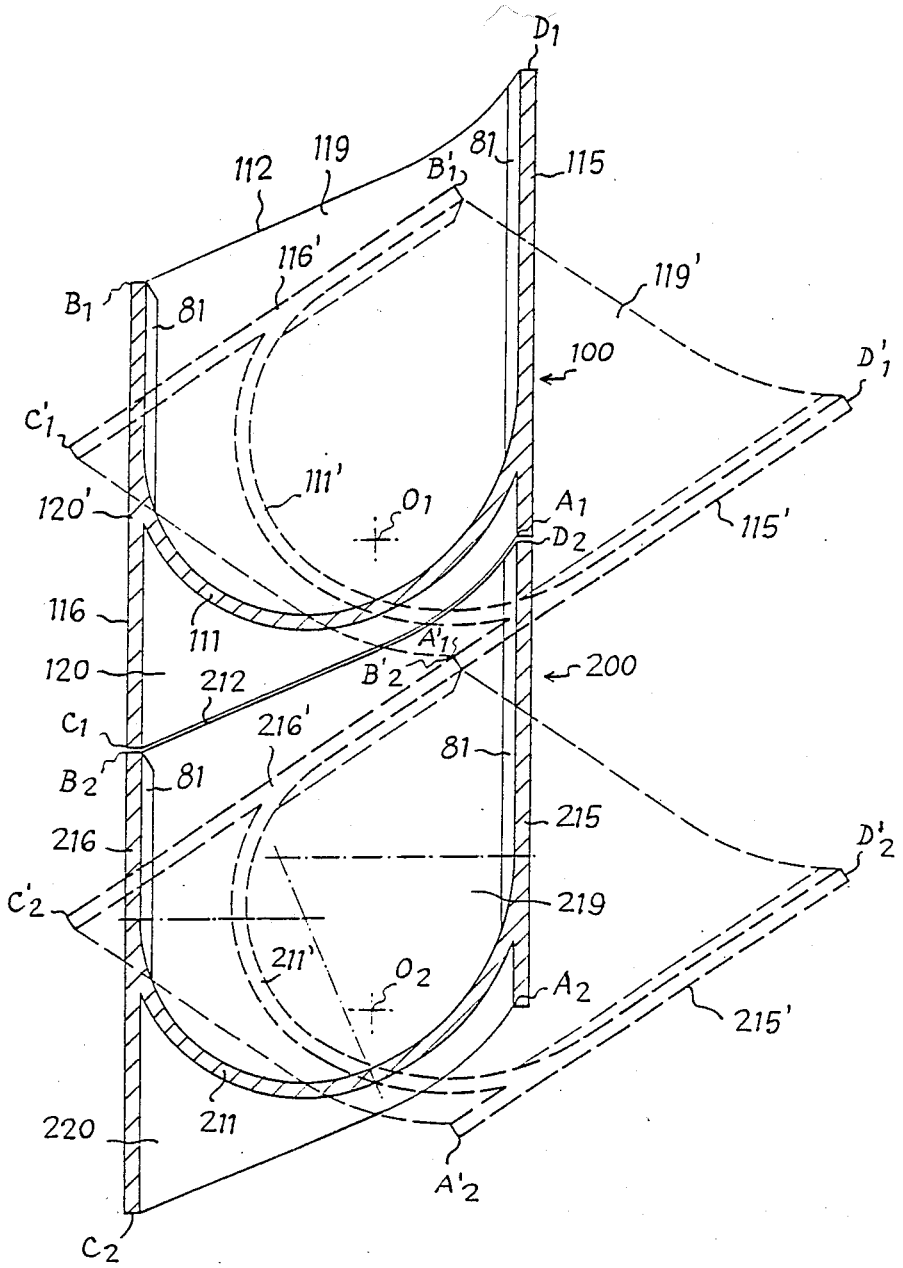
FIG. 7 is a vertical cutaway view similar to that of FIG. 3, but corresponding to a different embodiment and not revealing the frame.
Figure 8:
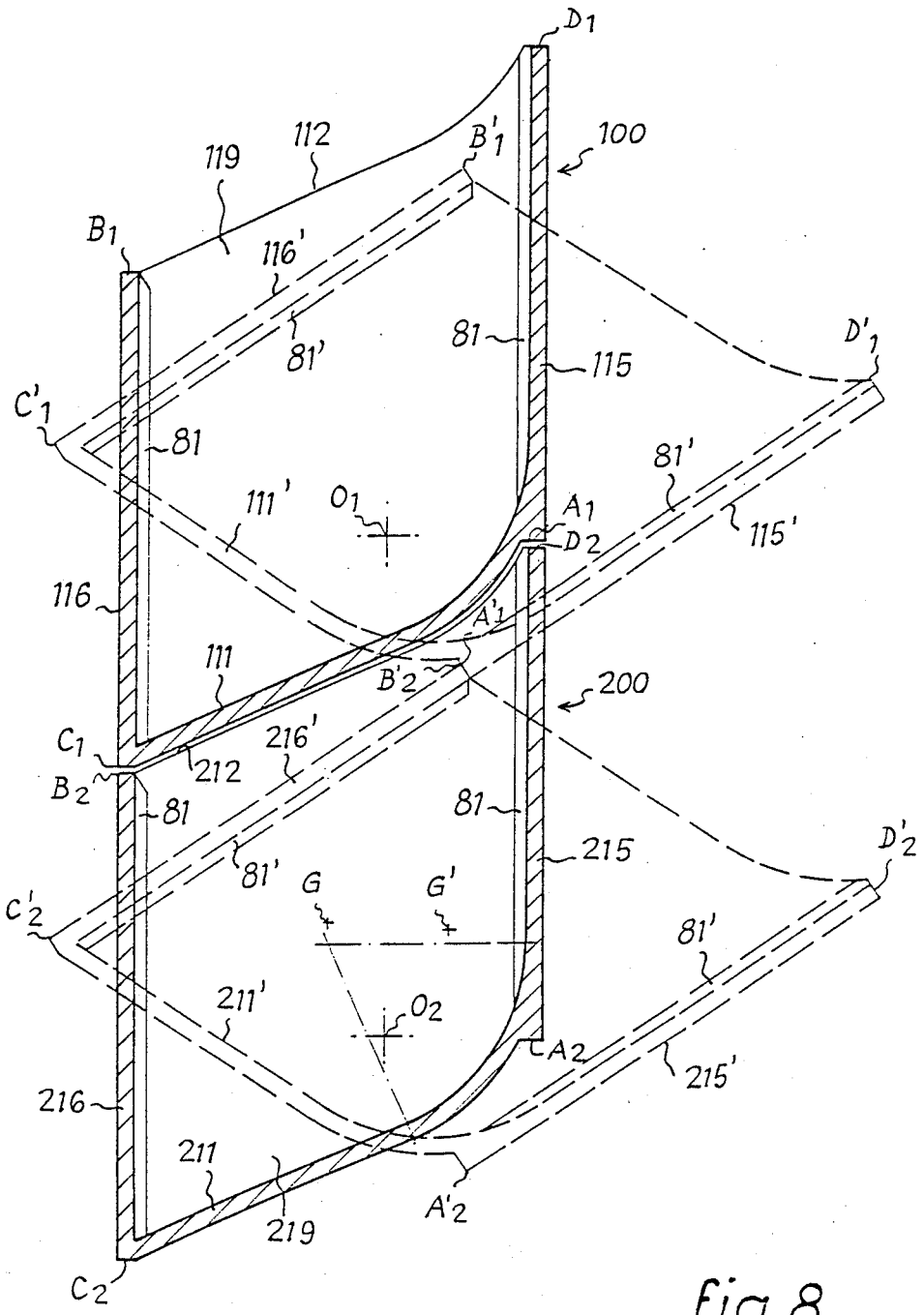
FIG. 8 is a vertical cutaway view corresponding to a variant of the embodiment of FIG. 7.
Figure 9:
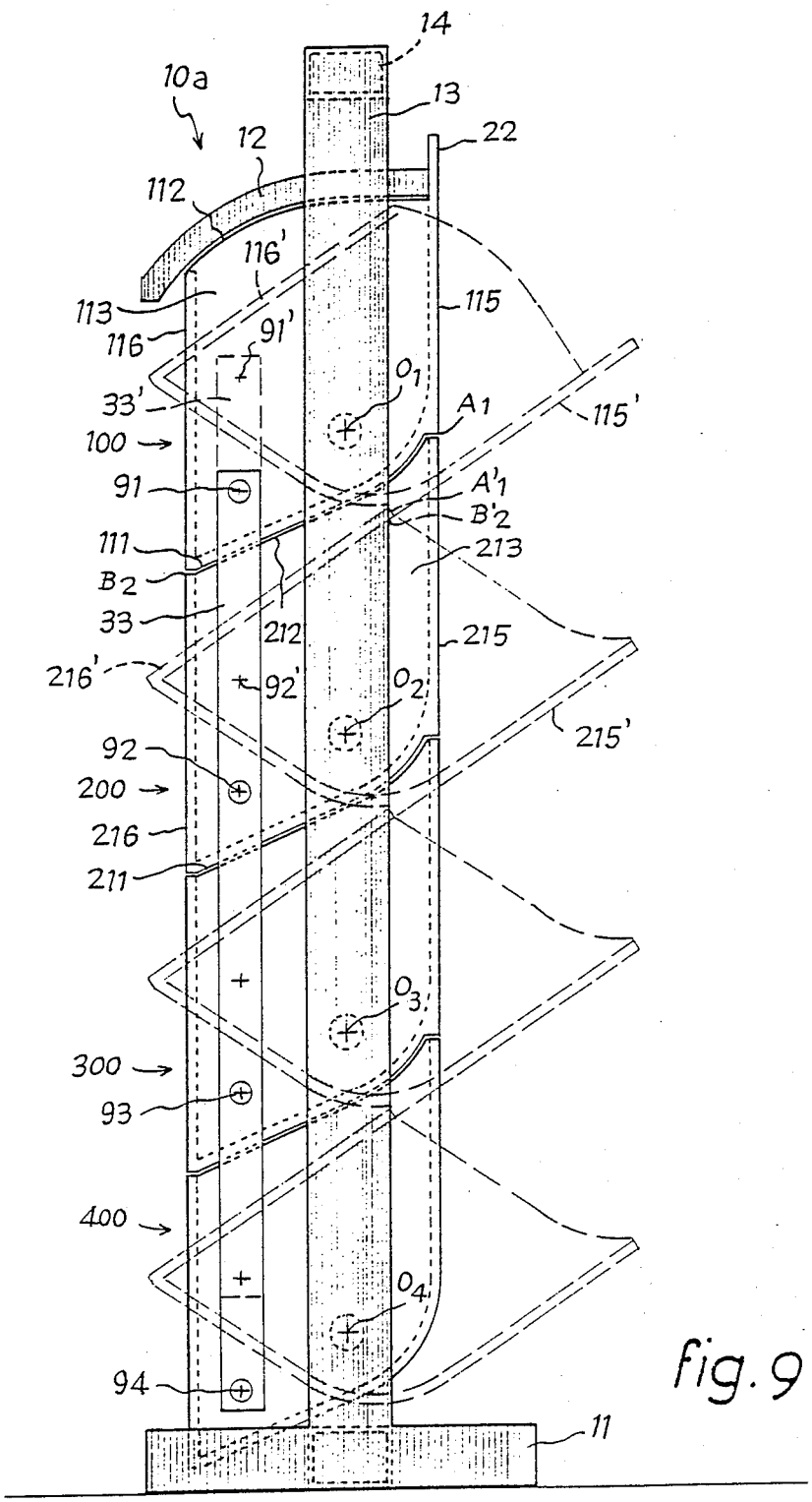
FIG. 9 is a side view of a storage cabinet having a frame in the form of a simple framing and comprising four rows of storage modules similar to the modules of FIG. 7.

FIGS. 7 to 9 concern other possible embodiments of the present invention in which the storage modules 100, 200 have a bottom wall 111, 211 which is at least partially curved and is thus more suitable for the storage of bulk objects. The embodiments of FIGS. 7 to 9 also have storage modules 100, 200 which, in the closed position, are entirely closed by themselves, independently of the frame, except for the upper part of the upper storage module 100. This makes it possible to embody a frame 10a which, apart from a basic base 11, may comprise only a single frame 13 integral with the base 11 able to comprise a handle 14 at its upper part and supporting the axes of rotation 01, 02 03, 04 of the storage modules 100, 200, 300, 400 (FIG. 9), and an upper plate 12 for sealing the upper part of the upper storage module 100 when the latter is in the closed position. FIG. 9 shows by way of example a storage cabinet with four superimposed storage modules 100, 200, 300, 400 entirely closed in the closed position and able to pivot simultaneously by means of at least one connecting rod 33 joined to horizontal axes 91, 92, 93, 94 mounted on the various modules 100, 200, 300, 400 and placed inside a given vertical plane. In the case of FIG. 9, all the modules 100, 200, 300, 400 may be identical with respect to each other. By way of a variant, the upper edge 112 of the lateral walls 113, 114 of the upper module 100, which cooperates with the fixed plate 12 of the frame, may have a form which is slightly different from that of the upper edges, such as 212 of the lateral walls of the other modules, and may be convex. However, the plate 12 and the upper edge 112 themselves have complementary forms.

In the embodiment of FIG. 9, the rear walls, such as 116, 216 of all the storage modules and the front walls, such as 115, 215, are perfectly aligned in the closing position of the modules and define two continuous parallel planes. In the opening position of the modules, the upper edges of the modules 200, 300, 400, such as B2 of the rear walls such as 216, simultaneously come and stop against the lower edge, such as A1 of the front wall such as 115 of the immediately upper module such as 100, as already indicated in detail with reference to the other figures of the drawing. The upper extremity 22 of the front wall 115 of the upper module 100 is used as a control tongue to simultaneously open or close the modules 100, 200, 300, 400 and serves as a stop against the plate 12 according to the closing position stop.

On FIG. 7, each module 100, 200 has a front flat face 115, 215, a bottom 111, 211 which is connected by a curved part to the front face 115, 215, said curved part extending by a rectilinear part inclined towards the bottom at the rear of the modules and is connected by forming an acute angle to the flat rear face 116, 216. The lower part of the flat front wall 115, 215, which defines the edge A1, A2, forms a small heel with respect to the bottom wall 111, 211 so as to enable the upper edge, such as B2 of the rear wall of the lower module, to come and stop in the opening position of the modules.

Moreover, FIG. 7 shows vertical ribs 81 formed on the internal face of the front and rear walls 115, 116 and 215, 216 of the modules 100, 200 opposite each other in order to retain separating, if necessary removable partitions 119, 219, which are parallel to the lateral faces of the modules and have the same form as the latter, so as to define several compartments inside a given storage module. Where the upper edge, such as 212, of a partition 219 has a form complementary from that of the bottom wall 11 of the immediately upper module in the closed position of the modules, each compartment itself is entirely closed.

FIG. 8 shows a variant of the embodiment of FIG. 9. In the case of FIG. 8, the bottom wall 111, 211 has a vertical section a curved form which is connected to the front walls 115, 215 and rear walls 116, 216 at a certain distance above the lower edges A1, C1, A2, C2 of the front and rear walls 115, 116, 215, 216. In this case, plates or ribs 120, 220 are formed under the bottom wall 111, 211 of the modules 100, 200 inside the plane of a separating partition 119, 219 or of a lateral wall, and extend as far as the level of the upper edge 212 of the partition 219 or of the lateral wall of the immediately lower adjacent module, whilst having a lower edge with a form complementary form that of said upper edge 212. In this way, each module and inside each module, each compartment is fully closed in the closing position of the modules (similarly in the case of the embodiment of FIGS. 3 and 4). In the embodiments of FIGS. 7 to 9, consideration has been taken to the axes of rotation 01, 02 disposed as in the case of the embodiment of FIGS. 3 and 4, but a disposition according to the diagram of FIG. 6 is of course possible.

Owing to the presence of front and rear rectilinear walls without undercuts, the storage modules 100, 200 can be easily embodied by using, for example, a plastic material, removal from the mould being able to be effected without difficulty and, in the open position, visibility and accessibility of the contents of the modules are total.

The closing system and the configuration of the modules are such that the volume delimited by the approximately parallel rear and front walls is 90 to 100% useable as a storage volume.

The manufacture of storage cabinets according to the invention can be embodied quickly at a low cost since the number of essential elements required can be significantly reduced and, due to self-locking of each of the different modules by the other modules in the opening position, the frame itself may be embodied very simply without it being necessary to add to it individual stop devices or rod assembly devices, since it essentially serves to support the axes of rotation and only really is used as an accessory for closing storage spaces.

The continuity of the front walls 115' and rear walls 216' in the opening position of the modules with for each module, except the upper module 100, a ceiling constituted by the front wall 115' of the immediately upper adjacent module 100 facilitates the guiding of objects and prevents these objects jamming between the different modules 100, 200.

What is claimed is:

1. A storage cabinet with pivoting storage compartments, comprising a frame, at least two superimposed rows of like storage modules pivotally mounted on the frame upon respective parallel, horizontal pivot axes spaced a distance y apart, so that corresponding points on vertically adjacent modules also lie a distance y apart, at least one connecting rod interconnecting said rows of modules so as to cause them to pivot in unison between open and closed positions, each storage module being delimited by front and rear planar walls having respective upper and lower edges, and by two lateral end walls and a bottom, the front walls of the storage modules being substantially coplanar in the closed position, the upper edge of the rear wall and the lower edge of the front wall of each module lying in paprallel planes a distance x apart, where x is less than the distance y, the upper edge of the rear wall of one module being lower that the lower edge of a front wall of its upper adjacent module, and the lower edge of a lateral wall of a module having a shape which is the complement of the upper edge of the corresponding lateral wall of the lower adjacent module so that all the superimposed storage modules, except for the upper part of the upper storage module, are entirely closed by themselves, independently of the frame, in the closed position, wherein an angle of rotation B between the open and closed positions of the storage modules is determined according to the equation $\sin\beta = x/y$, the difference z between the levels of said lower edge and of said upper edge being calculated according to the equation $z = y(1 - \cos\beta)$, and wherein, in the open position, the upper edge of the rear wall of the lower module abuts flat against the lower edge of the front wall of the upper module, thus precisely terminating the rotational movement of the modules and ensuring the continuity of the rear wall of each lower storage module with the front wall of its upper adjacent storage module in such a way that the two walls are substantially coplanar in the open position, whereby the entire useful storage volume of each storage module is visible and accessible.

2. A cabinet as recited in claim 1, wherein the frame includes framing members for supporting the pivot axes of the storage modules and a plate for sealing the upper part of the upper storage module.

3. A cabinet as recited in claim 1, further comprising intermediate partitions parallel to the lateral walls of the storage modules in order to provide closed compartments in the closed position, said intermediate partitions abutting the bottom of the adjacent upper module of a complementary form, or to a rib with a complementary form adjacent to the bottom of the adjacent upper storage module and, for the upper extremity module, coming into contact with a partition of complementary form integral with the frame.

4. A cabinet as recited in claim 1, wherein the pivot centers are situated at the rear of a plane defined by the upper rear stop edges of the storage modules.

5. A cabinet as recited in claim 1, wherein the pivot axes of the storage modules are situated below and at the rear of the plane defined by the upper rear stop edges of gravity of the modules corresponding respectively to one closing position and one opening position so as to enable the modules to pivot naturally between their open and closed positions.

6. A cabinet as recited in claim 1, wherein the rear wall of the storage modules are essentially level and aligned, but have at least at their upper part one partly curved or angled portion offset towards the exterior so as to increase the opening angle of the modules.

7. A cabinet as recited in claim 6, wherein the bottom wall of each storage module is bounded at its upper part by edges, also in the form of steps, and situated at a predetermined distance below the upper edges of the front and rear walls of the storage modules.

8. A storage cabinet with pivoting storage compartments, comprising a frame, at least two superimposed rows of like storage modules pivotally mounted on the frame upon respective parallel, horizontal pivot axes, at least one connecting rod interconnecting said rows of modules so as to cause them to pivot in unison between open and closed positions, each storage module being delimited by front and rear planar walls having respective upper and lower edges, and by two lateral end walls and a bottom, the front walls of the storage modules being substantially coplanar in the closed position, the upper edge of the rear wall of one module being lower than the lower edge of a front wall of its upper adjacent module, and the lower edge of a lateral wall of a module having a shape which is the complement of the upper edge of the corresponding lateral wall of the lower adjacent module so that all the superimposed storage modules, except for the upper part of the upper storage module, are entirely closed by themselves, independently of the frame, in the closed position, and wherein, in the open position, the upper edge of the rear wall of the lower module abuts flat against the lower edge of the front wall of the upper module, thus precisely terminating the rotational movement of the modules and ensuring the continuity of the rear wall of each lower storage module with the front wall of its upper adjacent storage module in such a way that the two walls are substantially coplanar in the open position, whereby the entire useful storage volume of each storage module is visible and accessible.

* * * * *